US008523172B2

(12) United States Patent
Kawamura

(10) Patent No.: US 8,523,172 B2
(45) Date of Patent: Sep. 3, 2013

(54) IMAGE FORMING APPARATUS

(75) Inventor: Hiroshi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/324,337

(22) Filed: Dec. 13, 2011

(65) Prior Publication Data

US 2012/0161391 A1 Jun. 28, 2012

(30) Foreign Application Priority Data

Dec. 24, 2010 (JP) ..... 2010-288431

(51) Int. Cl.
*B65H 3/06* (2006.01)

(52) U.S. Cl.
USPC ..... 271/114; 271/126

(58) Field of Classification Search
USPC ..... 271/10.13, 114, 118, 126, 127
See application file for complete search history.

(56) References Cited

U.S. PATENT DOCUMENTS 6,070,867 A * 6/2000 Tsurumi et al. ..... 271/114

FOREIGN PATENT DOCUMENTS

| | | | |
|---|---|---|---|
| EP | 0832833 | A2 | 4/1998 |
| EP | 0832833 | A3 | 12/1998 |
| EP | 0832833 | B1 | 4/2002 |

* cited by examiner

*Primary Examiner* — Michael McCullough
(74) *Attorney, Agent, or Firm* — Fitzpatrick, Cella, Harper & Scinto

(57) ABSTRACT

Provided is an image forming apparatus capable of preventing unnecessary sheet feeding when power is turned on. A state of a drive transmission portion 14A provided to transmit the driving of a drive portion to a feeding roller when a sheet is fed is switched from a second state that the driving of the drive portion is not transmitted to the feeding roller by a solenoid 19 to a first state that the driving of the drive portion is transmitted to the feeding roller and keep it. The controller for controlling the switching of the solenoid 19 and the driving of the drive portion to rotate the feeding roller drives the drive portion for a time necessary to return the drive transmission portion 14A from the first state to the second state to make the drive transmission portion 14A be in the second state when power is turned on.

7 Claims, 19 Drawing Sheets

HOME POSITION

MOVEMENT POSITION

FIRST PRESSING POSITION

SECOND PRESSING POSITION

POSITION WHEN SHEET CASSETTE IS INSERTED

*FIG. 7*

| RESPONSE | A | B | C | D |
|---|---|---|---|---|
| PHOTOINTERRUPTER 210a | ○ | × | × | ○ |
| PHOTOINTERRUPTER 210b | × | × | ○ | ○ |
| POSITION OF RACK 204 | HOME POSITION | | FIRST PRESSING POSITION | SECOND PRESSING POSITION |
| | WHEN CASSETTE IS INSERTED | | | |

DETECTION SIGNAL : ○

NO DETECTION SIGNAL : ×

IMAGE FORMING APPARATUS

BACKGROUND OF THE INVENTION

1. Field of the Invention

The present invention relates to an image forming apparatus, and more particularly, to a structure for reducing noise when a sheet cassette detachably mounted on the apparatus main body is extracted.

2. Description of the Related Art

Nowadays, among image forming apparatuses, such as a copying machine, a printer, and a facsimile, widely used image forming apparatuses are configured in such a manner that a sheet feeding device feeds a sheet to an image forming portion to form an image. Generally in such an image forming apparatus, a sheet cassette is detachably mounted on the apparatus main body, and sheets stored in the sheet cassette are fed to the image forming portion by a feeding roller.

For example, there is a known sheet cassette in which a sheet stacking portion stacks sheets inside the cassette main body and the sheets are pressed to the feeding roller can be lifted and lowered. In addition, when a sheet is fed, the sheet stacking portion is lifted so that the sheet is pressed to the sheet feeding roller and thus the sheet is fed by virtue of a pressing force (hereinafter, referred to as a feeding pressure) between the feeding roller and the top surface of the sheet. In an exemplary image forming apparatus, a drive source for lifting/lowering the sheet stacking portion is provided in the apparatus main body side, and, when the sheet cassette is mounted on the apparatus main body, the drive source lifts the sheet stacking portion so that the sheet is pressed to the feeding roller, and a feeding pressure is generated.

However, some of the image forming apparatuses of the related art have a sheet feeding device which transfers the sheet from the drive source to a rotation shaft at a predetermined timing. Such sheet feeding devices include a drive gear and a tooth-chipped gear. The drive gear is connected to the drive source such as a motor, and the tooth-chipped gear meshes with the drive gear and is rotated by the changes of the clutch mechanism. In addition, when the sheet is fed, the tooth-chipped gear is rotated by the clutch mechanism so as to mesh with the drive gear. In this way, the feeding roller is rotated (refer to U.S. Pat. No. 6,070,867).

FIG. 18 illustrates such a sheet feeding device of the related art. The sheet feeding device includes a feeding roller 920 and an intermediate lifting/lowering cam 908 which are attached to the rotation shaft 905. The sheet feeding device further includes a liftable intermediate plate 900 which is upwardly biased by a biasing member (not illustrated) and is provided with protrusions 909 at both ends. In addition, as the rotation shaft 905 is rotated, the intermediate plate 900 is lifted by the protrusion 909 and the intermediate lifting/lowering cam 908 which rotates in synchronization with the rotation shaft 905, and the sheets S stacked on the intermediate plate 900 are pressed to the feeding roller 920. Then, as the feeding roller 920 is rotated, and in consequence the sheets S are fed.

However, the sheet feeding device includes a drive gear 901 and a tooth-chipped gear 902. The drive gear 901 is connected to the drive source such as a motor (not illustrated). The tooth-chipped gear 902 is fixed to the rotation shaft 905, has a clutching mechanism, and meshes with the drive gear 901 by the changes of the clutch mechanism. The solenoid 906 illustrated in FIG. 18 includes an armature 907, a coil 913 that generates magnetism when an electric current flows across it, a frame 910 that efficiently transmits the generated magnetism, and a stator 914 that generates a magnetic force as illustrated in FIGS. 19A and 19B. The armature 907 is attached to the support point 911 of the frame 910 and is biased in the direction of an arrow F by the biasing force of the spring 912.

The armature 907 has a locking portion 904 at the leading edge thereof, and the tooth-chipped gear 902 has a locking claw 915 which engages with the locking portion 904 of the armature 907. Here, the tooth-chipped gear 902 is biased to rotate in the direction of an arrow W by the biasing member (not illustrated). However, the tooth-chipped gear 902 is held at a position where the tooth-chipped gear 902 does not mesh with the drive gear 901 because the locking portion 904 of the armature 907 engages with the locking claw 915 as illustrated in FIG. 19A until sheet feeding is initiated.

Then, as an electric current flows to the solenoid 906 for the sheet feeding, a magnetic force is generated in the stator 914 due to the magnetism generated from the coil 913, and the armature 907 is attracted toward the stator 914 as illustrated in FIG. 19B. In this manner, as the armature 907 is attracted to the stator 914, the locking between the locking portion 904 of the armature 907 and the locking claw 915 of the tooth-chipped gear 902 is released, and the tooth-chipped gear 902 is rotated in the direction of the arrow W and meshes with the drive gear 901.

As a result, the tooth-chipped gear 902 is rotated by the drive gear 901, which brings about the rotation of the rotation shaft 905 engaged with the tooth-chipped gear 902, and in consequence the intermediate lifting/lowering cam 908 integrated with the rotation shaft 905 becomes rotated. In this manner, as the intermediate lifting/lowering cam 908 is rotated, the intermediate plate 900 is lifted by the protrusions 909 provided at both ends of the intermediate plate 900, and the sheets S stacked on the intermediate plate 900 are is pressed to the feeding roller 920. In addition, since the tooth-chipped gear 902 and the feeding roller 920 are fixed to the rotation shaft together, the feeding roller 920 is rotated along with the tooth-chipped gear 902, thereby feeding the sheets S that are pressed to the feeding roller 920.

However, in such an image forming apparatus of the related art, the armature 907 of the solenoid 906 is locked when the apparatus is not used, and the position of the tooth-chipped gear 902 is held. Therefore, the tooth-chipped gear 902 does not mesh with the drive gear 901. However, if a strong vibration or impact is applied, for example, when the apparatus is transported after the apparatus is manufactured, or when the image forming apparatus is moved, the armature 907 of the solenoid 906 may be released from the locking claw 915 of the tooth-chipped gear 902.

If the armature 907 of the solenoid 906 is released as described above, the tooth-chipped gear 902 meshes with the drive gear 901. In this case, the sheet may be fed just by rotating the motor even when the solenoid is not driven during use of the apparatus, and therefore, it may generate a sheet jam and consume sheets uselessly.

SUMMARY OF THE INVENTION

In this regard, the invention provides an image forming apparatus capable of preventing unnecessary sheet feeding when the power is turned on.

An image forming apparatus that forms an image on a sheet fed by a feeding roller from a sheet cassette mounted on an apparatus main body, the image forming apparatus includes a drive portion that is provided in the apparatus main body to drive the feeding roller, a drive transmission portion that is capable of switching, by virtue of driving of the drive portion, from a first state in which the driving of the drive portion is transmitted to the feeding roller to a second state in which the driving of the drive portion is not transmitted to the feeding roller, a switching portion that switches the drive transmission portion from the second state to the first state when the sheet is fed, and makes the drive transmission portion, returned from the first state to the second state by virtue of driving of the drive portion, stay in the second state if the sheet is fed, and a controller that drives the drive portion for a time necessary to return the drive transmission portion from the first state to the second state so as to make the drive transmission portion be in the second state when power is turned on.

According to the invention, it is possible to prevent unnecessary sheet feeding when power is turned on by driving the drive portion for the time necessary to return the drive transmission portion from the first state to the second state. This ensures that the drive transmission portion will be in the second state as the power is turned on.

Further features of the present invention will become apparent from the following description of exemplary embodiments with reference to the attached drawings.

BRIEF DESCRIPTION OF THE DRAWINGS

FIG. 7 is a diagram illustrating output results of the photointerrupter depending on the operational position of the above-described rack;

FIG. 13 is a flowchart illustrating pre-rotation control when a typical printer main body of the above-described full-color laser beam printer is powered on;

FIG. 15 is a flowchart illustrating control performed when the above-described full-color laser beam printer is initially powered on;

DESCRIPTION OF THE EMBODIMENTS

Figure 1:
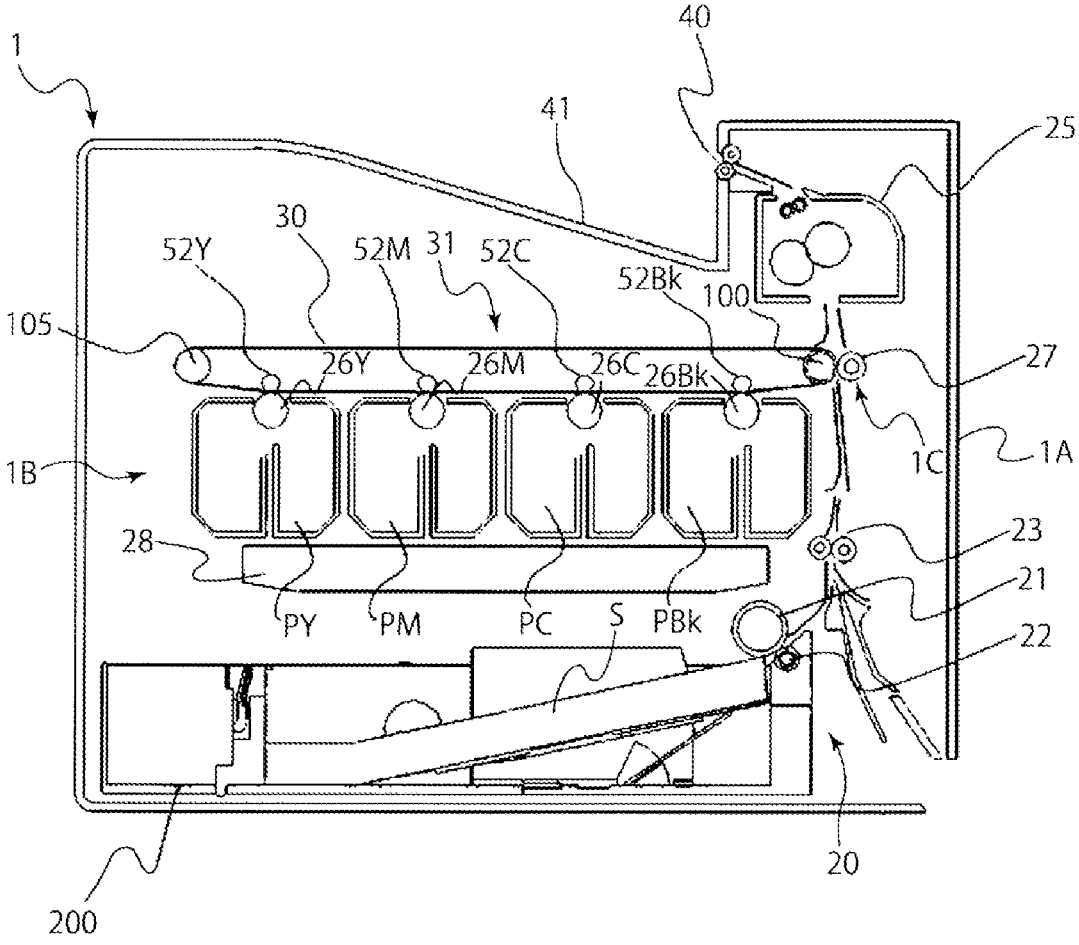
FIG. 1 is an entire configuration diagram of the full-color laser beam printer as an exemplary image forming apparatus according to a first embodiment of the invention.

Hereinafter, embodiments of the invention will be described in detail with reference to the accompanying drawings. FIG. 1 is an entire configuration diagram illustrating the full-color laser beam printer as an exemplary image forming apparatus according to a first embodiment of the invention. In FIG. 1, the full-color laser beam printer main body 1A (hereinafter, referred to as a printer main body) as a main body of the a full-color laser beam printer 1 includes an image forming portion 1B for forming an image on a sheet, a sheet feeding device 20 for feeding sheets, and the like.

The image forming portion 1B includes process cartridges P (PY, PM, PC, and PBk) for forming toner images for four colors including yellow, magenta, cyan, and black, respectively. The process cartridge P includes photosensitive drums 26 (26Y, 26M, 26C, and 26 Bk) as an image bearing member and is detachably mounted on the printer main body 1A. In addition, the image forming portion 1B has a scanner unit 28 arranged immediately below the process cartridge P to form an electrostatic latent image on the photosensitive drum 26 by irradiating a laser beam based on image information.

In FIG. 1, an intermediate transfer belt unit 31 includes an intermediate transfer belt 30 and primary transfer rollers 52 (52Y, 52M, 52C, and 52Bk) arranged at the inner side of the intermediate transfer belt 30. In addition, the intermediate transfer belt 30 is stretched between a drive roller 100 and a tension roller 105, and the tension roller 105 is configured to move horizontally depending on the length of the intermediate transfer belt 30. In addition, the primary transfer roller 52 is provided oppositely to each photosensitive drum 26 so that a transfer bias is applied by a bias application unit (not illustrated). In addition, since the primary transfer bias is applied to the intermediate transfer belt 30 using the primary transfer roller 52, each color toner image on the photosensitive drum is sequentially transferred to the intermediate transfer belt 30 so that a full-color image is formed on the intermediate transfer belt.

The secondary transfer portion 1C includes a drive roller 100 and a secondary transfer roller 27 to transfer the full-color image sequentially formed on the intermediate transfer belt 30 to the sheet. A fixing portion 25 fixes the toner image formed on the sheet by adding heat and pressure.

The sheet feeding device 20 includes a sheet cassette 200 detachably mounted on the installation space provided under the printer main body 1A, a feeding roller 21 included in a sheet feeding portion for feeding the sheets S stored in the sheet cassette 200. When the sheets S stored in the sheet cassette 200 are fed, the sheets S are fed by rotating the feeding roller 21 pressed on the sheets S. In addition, the sheets S fed in this manner are separated one by one using a separation portion including the feeding roller 21 and the separation roller 22 and then conveyed to a pair of registration rollers 23.

Next, an image forming operation of the full-color laser beam printer 1 configured in this manner will be described. As an image signal is input to the scanner unit 28 from a PC (not illustrated), laser light corresponding to the image signal is irradiated onto the photosensitive drum from the scanner unit 28. At this moment, the surface of the photosensitive drum 26 is uniformly charged with a predetermined polarity and electric potential in advance, and an electrostatic latent image is formed on the surface by irradiating the surface with laser light from the scanner unit 28. Then, the electrostatic latent image is developed by the developing unit provided in the process cartridge P and is visualized.

For example, first, the photosensitive drum 26Y is irradiated from the scanner unit 28 with laser light based on the yellow component color image signal of an original and a yellow electrostatic latent image is formed on the photosensitive drum. Then, the yellow electrostatic latent image is developed using a yellow toner from the developing unit to visualize the yellow toner image. Then, if the toner image reaches the primary transfer portion where the photosensitive drum 26Y and the intermediate transfer belt 30 abut as the photosensitive drum 26Y is rotated, the yellow toner image is transferred to the intermediate transfer belt with the primary transfer bias applied to the first transfer roller 52Y.

Then, as the portion bearing the yellow toner image of the intermediate transfer belt 30 moves, similarly, a magenta toner image formed on the photosensitive drum 26M is transferred to the intermediate transfer belt 30 from the yellow toner image as described above. Similarly, as the intermediate transfer belt 30 moves, the cyan toner image and the black toner image are transferred overlappingly on the yellow toner image and the magenta toner image in each primary transfer portion. As a result, a full-color toner image is formed on the intermediate transfer belt. In addition, in the intermediate transfer belt 30 to which the toner image has been secondarily transferred, transfer residual toner remaining on the surface is removed by a belt cleaner (not illustrated) provided in the vicinity of the tension roller 105.

Along with the toner image forming operation, the sheet S stored in the sheet cassette 200 is fed by the feeding roller 21, and then, conveyed to a pair of registration rollers 23. Then, the sheet conveyed to a pair of registration rollers 23 is timed by a pair of registration rollers 23 and conveyed to the secondary transfer portion 1C. In addition, in the secondary transfer portion 1C, toner images of four colors on the intermediate transfer belt 30 are secondarily transferred to the conveyed sheet S by applying a positive bias to the secondary transfer roller 27.

The sheet S to which the toner image is transferred is conveyed to the fixing portion 25. In the fixing portion 25, a full-color toner image is fixed on the surface thereof as a permanent image by applying heat and pressure on the surface. Then, after the full-color toner image is fixed as a permanent image, the sheet S is discharged to a discharge tray 41 through a pair of discharge rollers 40.

Figure 12:
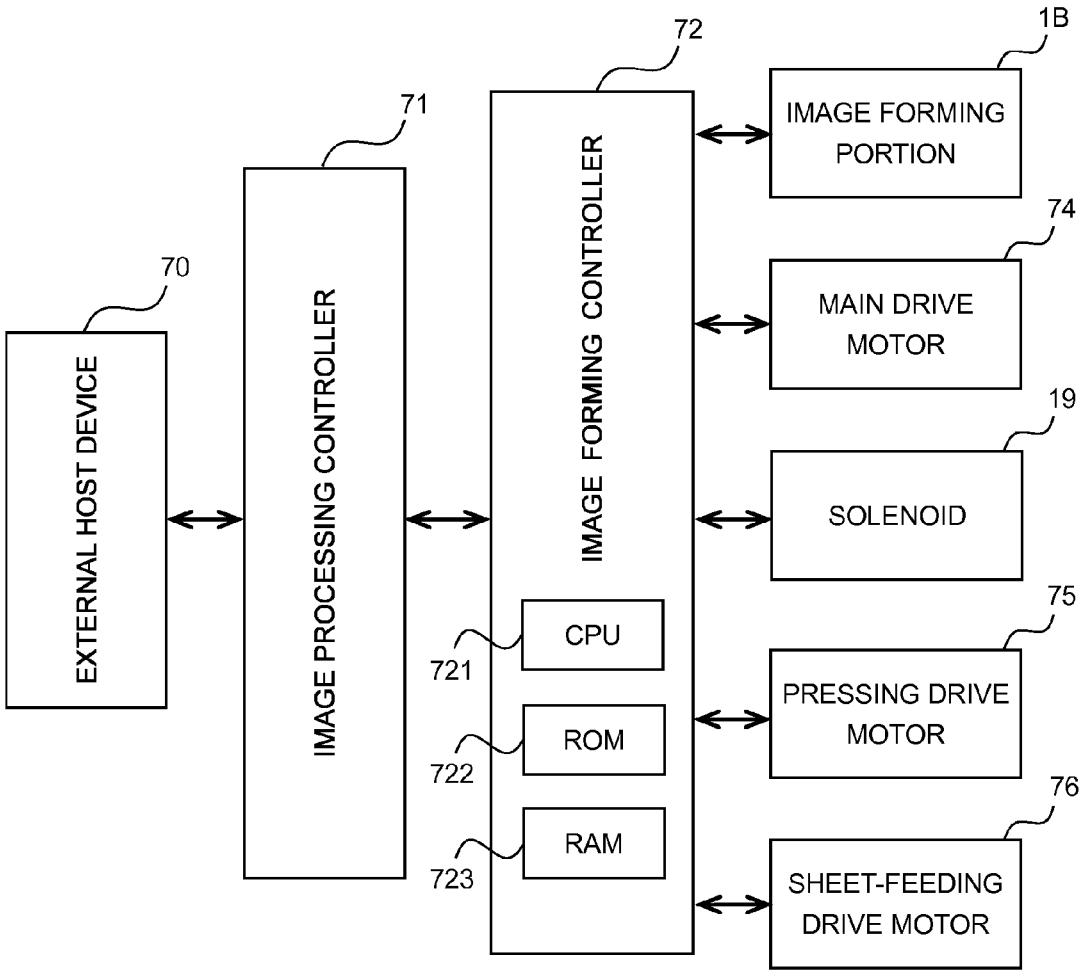
FIG. 12 is a control block diagram illustrating the above-described full-color laser beam printer.

Here, the sheet cassette 200 is detachably attachable in the near front direction of the printer main body 1A, that is, in the direction perpendicular to the sheet feeding direction. As the sheet cassette 200 is mounted on the printer main body 1A, an image forming controller which is a controller of the printer main body 1A as illustrated in FIG. 12 described below determines that the sheet cassette 200 is mounted on the printer main body 1A using a presence/absence detection unit described below.

Figure 2:
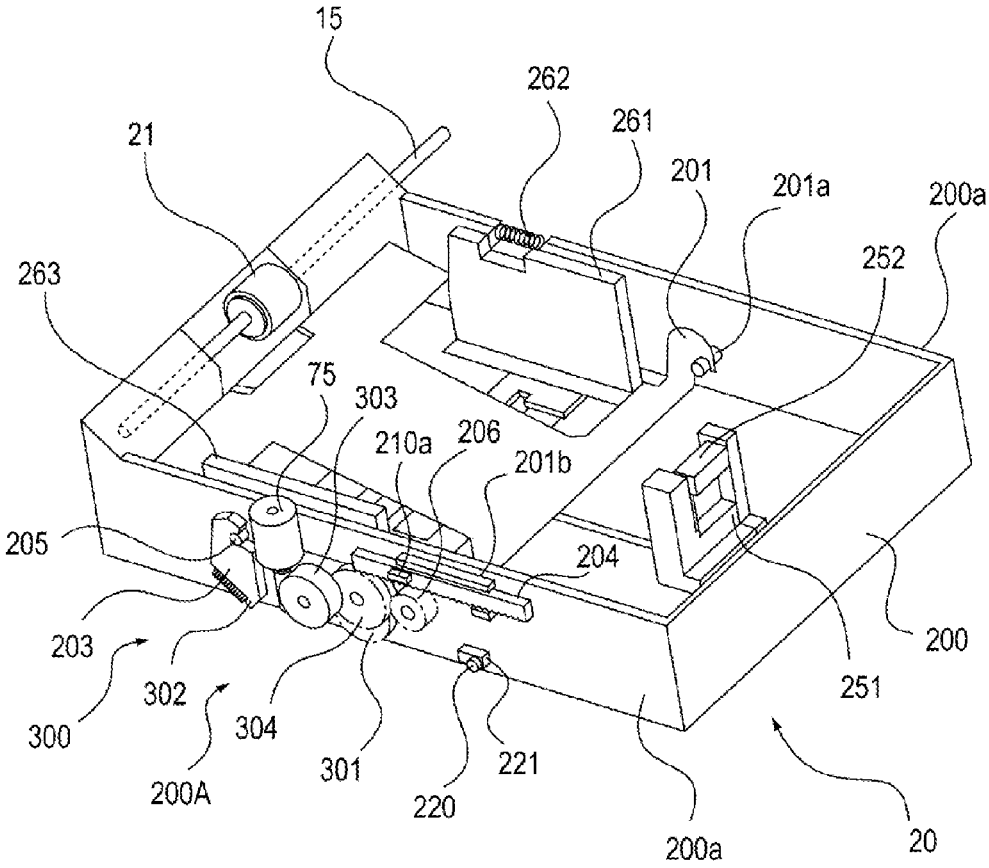
FIG. 2 is a diagram illustrating a configuration of the sheet cassette of the above-described full-color laser beam printer.

FIG. 2 is a diagram illustrating a configuration of the sheet cassette 200. The sheet cassette 200 can store the sheets having an A5 longitudinal size to a letter longitudinal size. Here, the sheet cassette 200 has a cassette main body 200*a* for storing a plurality of sheets. In the cassette main body 200*a*, an intermediate plate 201 which is a sheet stacking portion for stacking the sheets is provided pivotably (liftably) with respect to a pivot point 201*a*.

In the cassette main body 200*a*, a rear edge control member 251 for controlling the rear edge, which is an upstream side end in the sheet feeding direction of the sheet on the intermediate plate 201, is provided slidably in the sheet feeding direction. The rear edge control member 251 is configured to slidably move to the upstream and downstream sides in the sheet feeding direction when a user manipulates the lever 252 of the rear edge control member 251 so as to arrange the sheets at the position depending on the sheet size.

In the sheet cassette 200, a front side control plate 261 and a back side control plate 263 constituting a pair of side end control portions for controlling positions in the width direction perpendicular to the sheet feeding direction of the sheet on the intermediate plate 201 are provided slidably in the width direction. Here, the front side control plate 261 and the back side control plate 263 are connected to each other using a rack portion and a pinion gear (not illustrated). Therefore, as a user manipulates a lever 262 provided in the front side control plate 261, the front side control plate 261 and the back side control plate 263 move in the width direction in synchronization.

Figure 3:
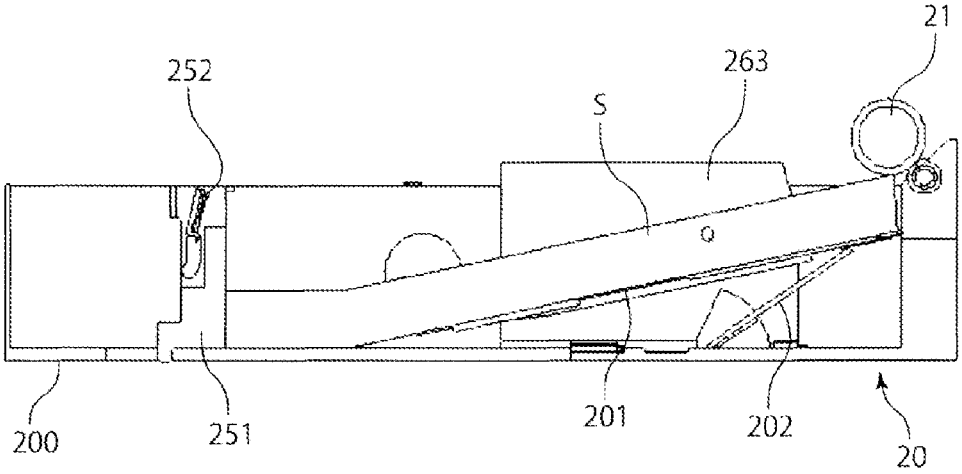
FIG. 3 is a diagram illustrating a configuration of the sheet feeding device of the above-described full-color laser beam printer.

In addition, in the downstream side of the intermediate plate 201, as illustrated in FIG. 3, a pressing lever 202 for pushing up the intermediate plate 201 toward the feeding roller 21 is provided. In addition, the pressing lever 202 has the leading edge thereof contacting the bottom surface of the intermediate plate 201 at the center of the intermediate plate 201. In addition, the pressing lever 202 is connected to a pressing arm 203 for pivoting the intermediate plate 201 in the vertical direction by pivoting the pressing lever 202 in the vertical direction, as illustrated in FIG. 2, in the downstream (hereinafter, referred to as the back side) of the cassette installation direction of the cassette main body 200*a*.

Here, the pressing arm 203 is driven (operated) by the lifter drive mechanism 200A, which is an operation mechanism illustrated in FIG. 2. According to the present embodiment, the pressing lever 202, the pressing arm 203, and the lifter drive mechanism 200A constitute a lift mechanism for pushing up the intermediate plate 201 to make the sheets which are stacked on the intermediate plate 201 pressed to the feeding roller 21. As the sheet cassette 200 is mounted, the lift mechanism is connected to a drive transmission gear 301 described below so as to lift the intermediate plate 201. As the connection with the drive transmission gear 301 is released when the sheet cassette 200 is extracted, the intermediate plate 201 is lowered.

Figure 4:
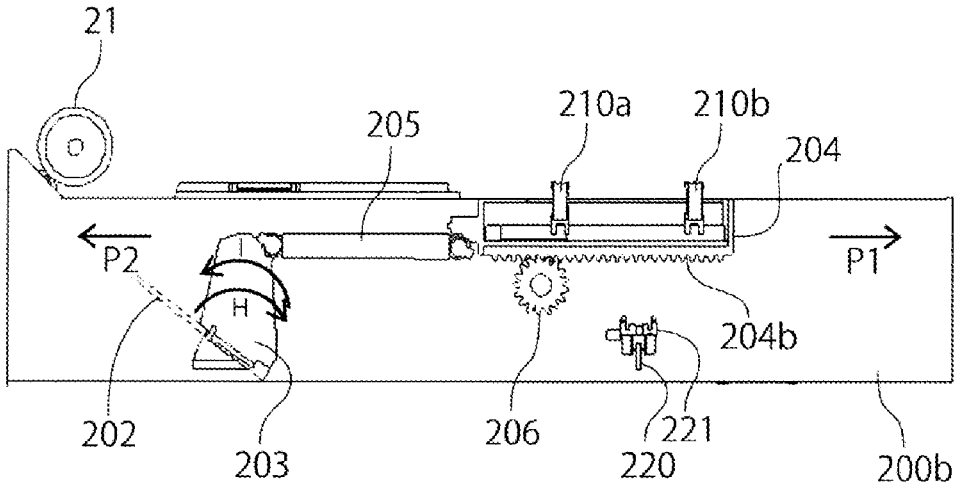
FIG. 4 is a diagram illustrating a configuration of a lifter drive mechanism of the above-described sheet feeding device.

As illustrated in FIG. 4, the lifter drive mechanism 200A has a pressing spring 205 which is a tensile coil spring of which one end is locked in the pressing arm 203 so as to set, depending on the sheet size, a pressing force for making the sheet on the intermediate plate pressed to the feeding roller 21. In addition, a rack 204 is provided on a wall surface 200*b* of the back side of the sheet cassette 200, such that the other end of the pressing spring 205 is locked, and the rack 204 is movable along the sheet feeding direction as illustrated in the arrows P1 and P2. In addition, using the pressing spring 205 and the rack 204, the sheets on the intermediate plate (on the sheet stacking portion) are pressed to the feeding roller 21 with a pressing (feeding pressure) in a magnitude depending on the sheet size by the pressing arm 203 and the pressing lever 202.

In FIG. 4, a cassette gear 206 is provided on the back side wall surface 200*b* of the sheet cassette 200 and meshes with the gear 204*b* of the rack 204 to serve as a pinion gear. As the sheet cassette 200 is mounted, the cassette gear 206 meshes with the drive transmission gear 301 provided in the printer main body 1A of FIG. 2. In addition, as the drive transmission gear 301 is rotated by a pressing drive unit 300 provided in the printer main body 1A, the drive is transmitted to the cassette gear 206 so that the cassette gear 206 is rotated. As a result, the rack 204 moves, and accordingly, the intermediate plate 201 is lifted or lowered by the pressing arm 203 and the pressing lever 202.

Figure 5:
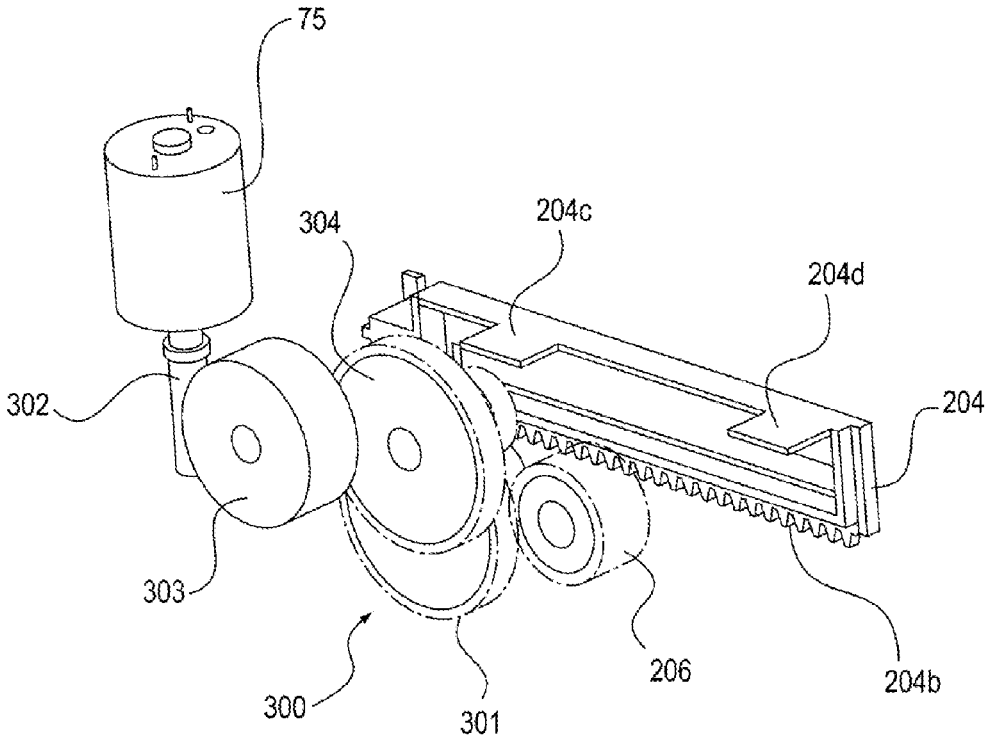
FIG. 5 is a diagram illustrating a configuration of the pressing drive unit of the above-described lifter drive mechanism.

Here, as illustrated in FIG. 5, the pressing drive unit 300 includes a pressing drive motor 75 having a worm gear 302, a deceleration gear 303 meshing with the worm gear 302, a deceleration gear 304, and a drive transmission gear 301 meshing with the cassette gear 206. In addition, the driving of the pressing drive motor 75 which is a lifting/lowering drive portion for lifting/lowering the intermediate plate 201 is transmitted to the cassette gear 206 through the worm gear 302, the deceleration gear 303, the deceleration gear 304, and the drive transmission gear 301 so as to move the rack 204.

A detection protrusion 220 of FIG. 4 is provided on the wall surface 200*b* of the back side of the sheet cassette 200, and the photointerrupter 221 is fixed to the printer main body 1A. As the sheet cassette 200 is mounted on the printer main body 1A, the detection protrusion 220 at the sheet cassette side is detected by the photointerrupter 221. In this manner, according to the present embodiment, a presence/absence detection unit for detecting presence/absence of the sheet cassette 200 is configured using the detection protrusion 220 and the photointerrupter 221. The image forming controller 72 (CPU 721 thereof) of FIG. 12 described below determines whether the sheet cassette 200 is mounted on the printer main body 1A based on the signal from the photointerrupter 221.

As illustrated in FIG. 5, the rack 204 includes detection protrusions 204*c* and 204*d*. In addition, in the printer main body 1A, the two photointerrupters 210*a* and 210*b* of FIG. 4 are provided on a movement locus of the detection protrusions 204*c* and 204*d*. Here, the detection protrusions 204*c* and 204*d* and the photointerrupters 210*a* and 210*b* as a sensor constitute an operational position detection unit so as to detect the operational position of the rack 204 by combining responses from the photointerrupters 210*a* and 210*b*.

Figure 6A:
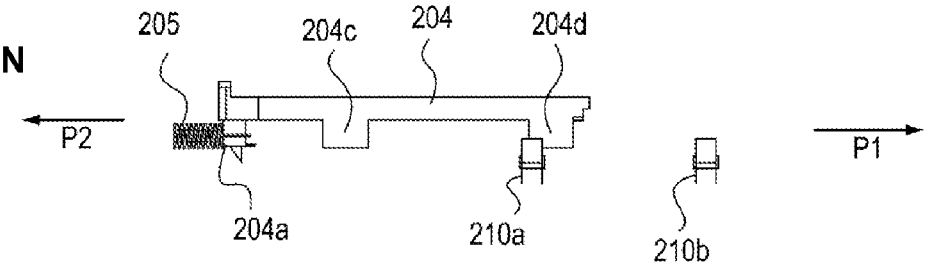
FIGS. 6A to 6E are diagrams illustrating a relationship between the operational position of the rack provided in the above-described lifter drive mechanism and the response of the photointerrupter.

Next, a relationship between the operational position of the rack 204 and the responses of the photointerrupters 210*a* and 210*b* will be described with reference to FIGS. 6A to 6E. FIG. 6A illustrates a position of the rack 204 at a home position. The signal of the photointerrupters 210*a* and 210*b* at this time corresponds to the response A in FIG. 7. That is, when the rack 204 is at the home position, the photointerrupter 210*a* is marked as o (detection signal is present), and the photointerrupter 210*b* is marked as x (detection signal is absent).

Figure 6B:
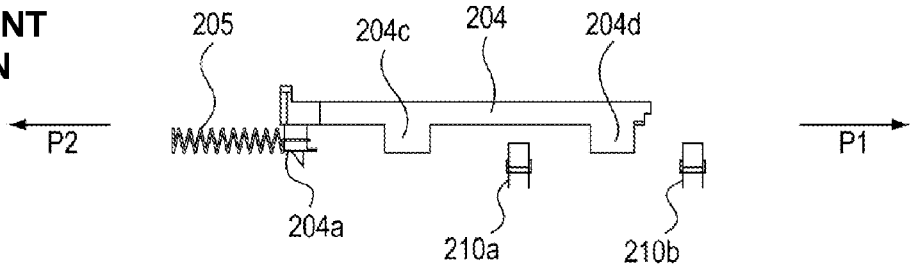
Figure 6C:
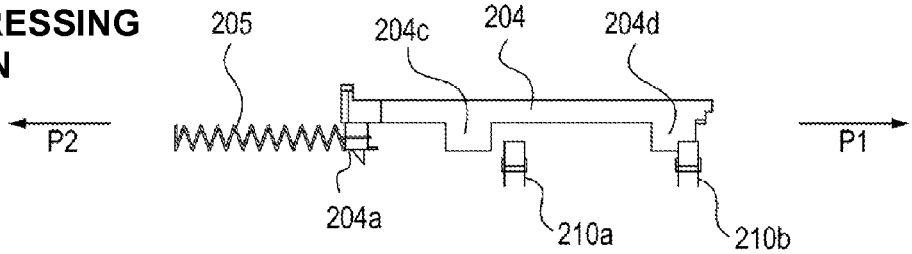

FIG. 6B illustrates an exemplary position of the rack 204 between the home position and a first pressing position and corresponds to the response B in FIG. 7. That is, when the rack 204 is positioned between the home position and the first pressing position, the photointerrupters 210*a* and 210*b* are marked as x. FIG. 6C illustrates a position of the rack 204 at the first pressing position and corresponds to the response C in FIG. 7. That is, when the rack 204 is positioned at the first pressing position, the photointerrupter 210*a* is marked as x, and the photointerrupter 210*b* is marked as o.

Figure 6D:
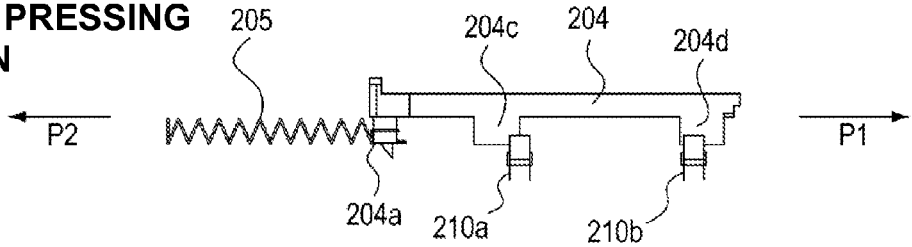
Figure 6E:
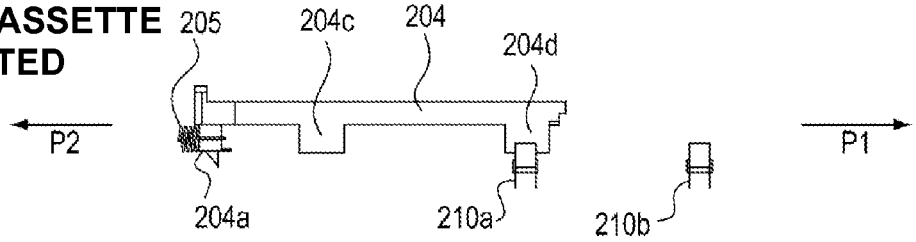

FIG. 6D illustrates a position of the rack 204 at the second pressing position and corresponds to the response D in FIG. 7. That is, when the rack 204 is positioned at the second pressing position, the photointerrupters 210*a* and 210*b* are marked as o. In addition, FIG. 6E illustrates a position of the rack 204 when the sheet cassette 200 is mounted on the printer main body 1A and corresponds to the response A in FIG. 6A. That is, according to the present embodiment, the response A in FIG. 7 corresponds to two kinds of rack positions.

According to the present embodiment, when the sheet cassette 200 is inserted into the printer main body 1A, the detection protrusion 204*d* is detected by the photointerrupter 210*a*. In this case, a pressing force for applying a necessary feeding pressure is read from data such as a sheet size and a basis weight, input from a user, based on a data table recorded in the ROM 722. In addition, control is performed such that the rack is moved to a predetermined pressing position during the sheet feeding so as to obtain a pressing force necessary to feed the sheet.

Figure 8:
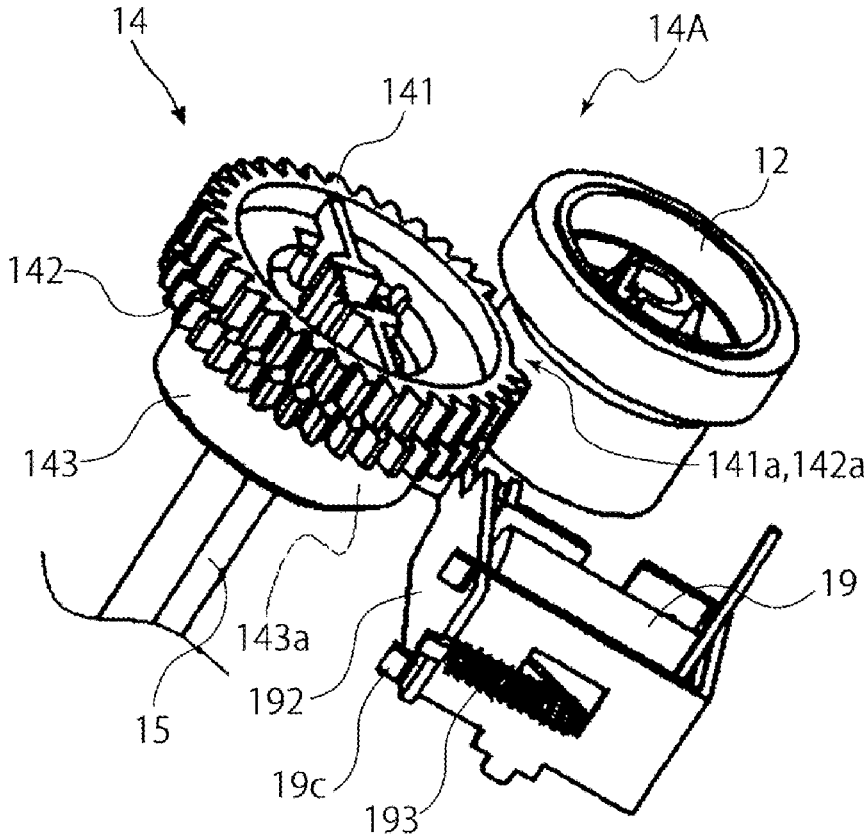
FIG. 8 is a diagram illustrating a configuration of the drive portion of the above-described sheet feeding device.

Next, a configuration of the drive portion of the sheet feeding device 20 will be described. In FIG. 8, the tooth-chipped gear unit 14 is attached to rotate in synchronization with a sheet-feeding shaft 15 and serves as a tooth-chipped gear unit for transmitting the driving of the drive gear 12 to the feeding roller 21. The drive gear 12 for transmitting the driving force to the tooth-chipped gear unit 14 is rotated at all times in the counterclockwise direction by the gear array and the sheet-feeding drive motor, which is a drive portion for driving the feeding roller of FIG. 12 described below, and has teeth across the entire circumference.

The tooth-chipped gear unit 14 includes a drive tooth-chipped gear 141, a control tooth-chipped gear 142 pivotably attached at a certain angle with respect to the drive tooth-chipped gear 141, and a tooth-chipping control cam 143 integrated with the control tooth-chipped gear 142. In addition, the sheet-feeding shaft 15 is connected to the feeding roller 21 as illustrated in FIG. 2 and is rotated in synchronization with the feeding roller 21.

In FIG. 8, the solenoid 19 locks the tooth-chipping control cam 143 and stops the tooth-chipped portions 141*a* and 142*a* of the drive tooth-chipped gear 141 and the control tooth-chipped gear 142 at the position of the drive gear 12. The solenoid 19 includes an armature 192, an armature holding portion 19*c* for pivotably holding the armature 192, and a solenoid spring 193 for applying a recovery force to the armature 192.

Here, the leading edge of the armature 192 is locked with the locking portion 143*a* of the tooth-chipping control cam 143 until the sheet feeding operation is initiated and as the sheet feeding operation is terminated. The locking with the locking portion 143*a* is released as the sheet feeding operation is initiated. As the locking with the armature 192 is released, as described below, the tooth-chipping control cam 143 is rotated. Accordingly, the sheet-feeding shaft 15 is rotated in synchronization with the feeding roller 21. In this manner, the initiation and stopping of the operation of the feeding roller 21 is controlled by the armature 192.

Figure 9:
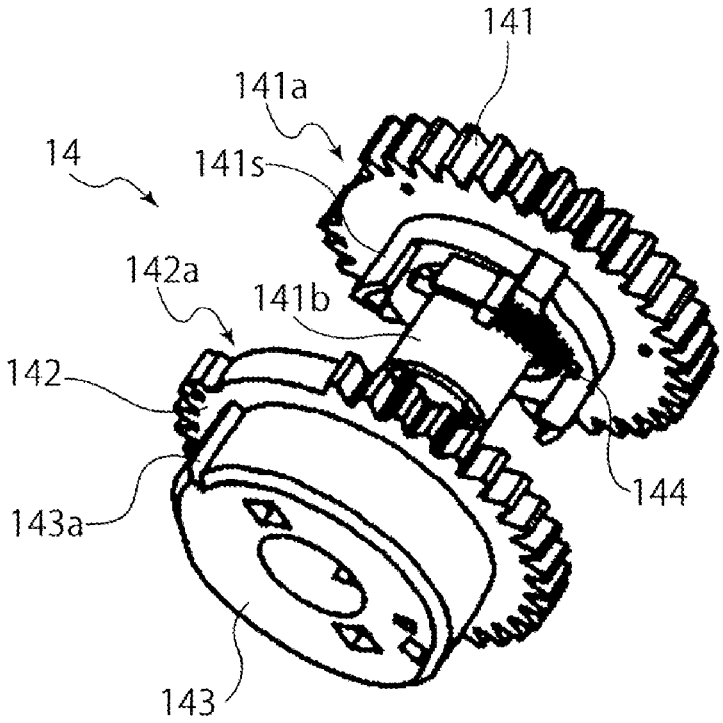
FIG. 9 is a diagram illustrating a configuration of the tooth-chipped gear unit provided in the drive portion of the above-described sheet feeding device.

The drive tooth-chipped gear 141 and the control tooth-chipped gear 142 are assembled such that the hole of the control tooth-chipped gear 142 is rotatably fit into a shaft 141*b* of the drive tooth-chipped gear 141 as illustrated in FIG. 9. When the control tooth-chipped gear 142 is assembled in this manner, the control tooth-chipped gear 142 is biased by the spring force of the tooth-chipped spring 144 provided in the drive tooth-chipped gear 141 and bumps into the stopper 141*s* provided in the drive tooth-chipped gear 141. As the control tooth-chipped gear 142 bumps into the stopper 141*s* in this manner, the control tooth-chipped gear 142 and the drive tooth-chipped gear 141 are rotated in synchronization.

Here, the control tooth-chipped gear 142 is resistant to the spring force of the tooth-chipping spring 144 and held at the position separated from the stopper 141*s* while the armature 192 is locked with the tooth-chipping control cam 143 as described below. In addition, as the locking of the armature 192 is released, the control tooth-chipped gear 142 is rotated in the direction meshing with the drive gear 12 by virtue of the spring force of the tooth-chipping spring 144 as an initial rotation applying portion (biasing portion) and bumps into the stopper 141*s* of the drive tooth-chipped gear 141.

The rotation angle of the control tooth-chipped gear 142 against the drive tooth-chipped gear 141 is an angle from the standby position where the control tooth-chipped gear 142 is locked with the armature 192 through the tooth-chipping control cam 143 to the position where the control tooth-chipped gear 142 is released from being locked with the armature 192, and the control tooth-chipped gear 142 bumps into the stopper 141*s* of the drive tooth-chipped gear 141. That is, the control tooth-chipped gear 142 is rotated with a certain angle until it bumps into the stopper 141*s* as the locking of the armature 192 is released.

Here, the rotation angle of the control tooth-chipped gear 142 is set to an angle at which it meshes with the drive gear 12 when the control tooth-chipped gear 142 bumps into the stopper 141*s*. As the control tooth-chipped gear 142 meshes with the drive gear 12 in this manner, then, the drive tooth-chipped gear 141 as well as the control tooth-chipped gear 142 is rotated in synchronization.

In this manner, according to the present embodiment, the drive transmission portion 14A for transmitting the driving of the sheet-feeding drive motor to drive the feeding roller 21 during the sheet feeding includes the drive gear 12, the drive tooth-chipped gear 141, and the control tooth-chipped gear 142 meshing with the drive gear 12 to rotate the feeding roller 21. The drive transmission portion includes the tooth-chipping spring 144 and the solenoid 19 releasably locked with the control tooth-chipped gear 142. In addition, by virtue of the drive transmission portion having such a configuration, the control tooth-chipped gear 142 and the drive tooth-chipped gear 141 after the sheet feeding are rotated to the standby position where the tooth-chipped portions 141*a* and 142*a* face the drive gear 12 as described below and are locked by the armature 192 of the solenoid 19 to stop.

Figure 10:
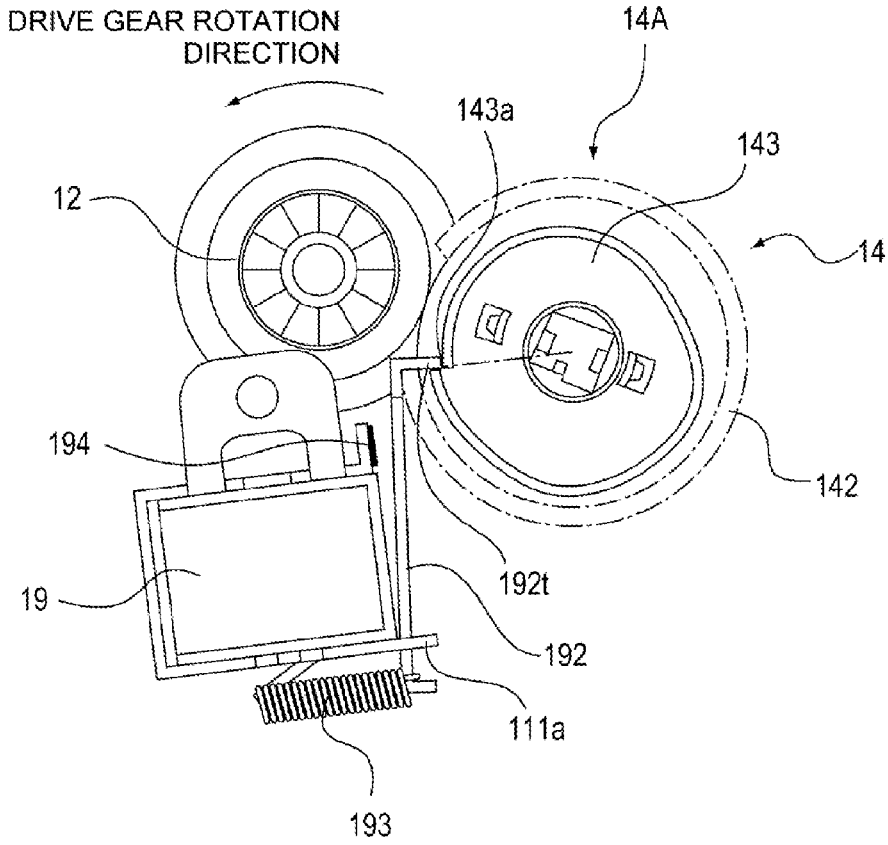
FIG. 10 is a diagram illustrating a state that the tooth-chipped gear unit and a feeding solenoid of the above-described drive portion are at a standby position.

Next, a rotational drive operation of the feeding roller 21 using the drive portion configured in this manner will be described. FIG. 10 is a diagram illustrating a state at which the solenoid 19 and the tooth-chipped gear unit 14 are at the standby position. At this state, the control tooth-chipped gear 142 stops at the standby position when the leading edge 192*t* of the armature 192 is caught by the locking portion 143*a* of the tooth-chipping control cam 143. In addition, the armature 192 at that time is at the open position where the absorption is opened when the solenoid 19 is powered off.

Figure 11:
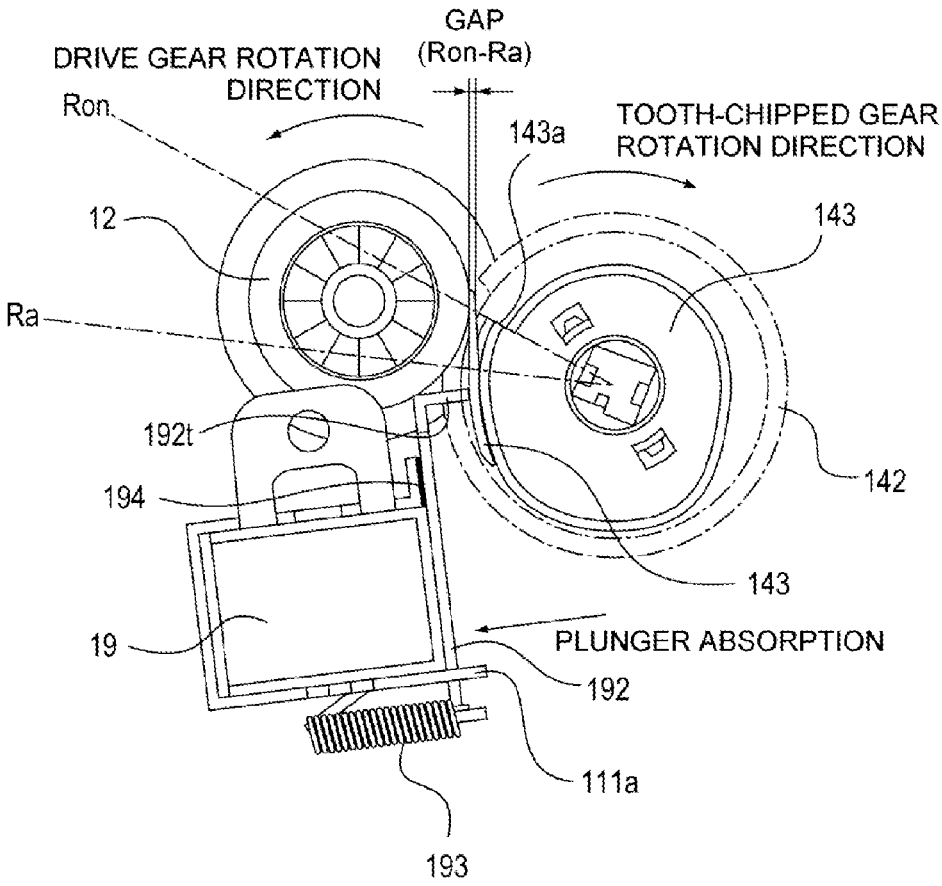
FIG. 11 is a diagram illustrating a state that the feeding solenoid of the above-described drive portion is operated.

When the feeding roller 21 is rotated, the solenoid 19 is powered on. As a result, the armature 192 is absorbed and separated from the locking portion 143*a* of the tooth-chipping control cam 143 of the control tooth-chipped gear 142 as illustrated in FIG. 11 so that the locking with the locking portion 143*a* is released (absorption position). The released control tooth-chipped gear 142 is rotated by the spring force of the tooth-chipping spring 144 so as to mesh with the drive gear 12 and rotate in synchronization with the drive gear 12.

Then, when the control tooth-chipped gear 142 is rotated by a predetermined angle (here, about 35°) from the standby position, it bumps into the stopper 141*s* of the drive tooth-chipped gear 141. As a result, the control tooth-chipped gear 142 is connected to the drive tooth-chipped gear 141 and is rotated in synchronization. That is, the control tooth-chipped gear 142 becomes free by virtue of the operation of the solenoid 19, first, the control tooth-chipped gear 142 is rotated by the force of the tooth-chipping spring 144, and at last, meshes with the drive gear 12 so that the rotation is initiated. Then, when the control tooth-chipped gear 142 is rotated by about 35°, the control tooth-chipped gear 142 bumps into the stopper 141*s* and is connected to the drive tooth-chipped gear 141. Then, accordingly, the drive tooth-chipped gear 141 is rotated from the standby position to the position where it meshes with the drive gear 12. As a result, a driving force is applied to the feeding roller 21.

Meanwhile, when the feeding roller 21 is rotated by one turn after that, the control tooth-chipped gear 142 makes the locking portion 143*a* of the tooth-chipping control cam 143 be caught by the armature 192 of the solenoid 19. When the armature 192 of the solenoid 19 is caught in this manner, the tooth-chipping control cam 143 stops. Then, the drive tooth-chipped gear 141 is rotated by about 35° and stops at the standby position where the tooth-chipped portion faces the drive gear 12.

In FIG. 11 which illustrates a state in which the control tooth-chipped gear 142 is rotated by about 35°, the radius Ron ranges from the rotation center of the tooth-chipping control cam 143 to the leading edge position of the armature 192 in the solenoid absorption state. In addition, the radius Ra of a first cam surface 143*b* ranges from the rotation center of the tooth-chipping control cam 143 to a meshing start portion where the control tooth-chipped gear 142 meshes with the drive gear 12.

Here, according to the present embodiment, the radius Ron to the leading edge position of the armature 192 in the solenoid absorption state is set to be larger than the radius Ra to the meshing start position of the tooth-chipping control cam 143. As a result of such setting, it is possible to prevent the leading edge of the armature 192 and the tooth-chipping control cam 143 from making contact with each other and generating operational errors in the operational area where the control tooth-chipped gear 142 is rotated by the force of the initial tooth-chipping spring 144.

FIG. 12 is a control block diagram illustrating the full-color laser beam printer 1. The image forming controller 72 controls the image forming portion 1B based on the image data from the image processing controller 71 which processes the image information input from an external host device 70. The image forming controller 72 includes a CPU 721, a ROM 722 which internally stores a control program corresponding to the flowchart of FIG. 13 described below, and a RAM 723 used as a work area for the operation caused by the control or as an area for temporarily holding the control data. The image forming controller 72 as a controller is connected to the main drive motor 74, the solenoid 19, the pressing drive motor 75, and the sheet-feeding drive motor 76, in addition to the image forming portion 1B. According to the present embodiment, the sheet-feeding drive motor 76 is a stepping motor.

Next, control operations of the present embodiment will be described. First, pre-rotation control when a typical printer main body 1A is powered on will be described with reference to the flowchart of FIG. 13. The pre-rotation control is necessary to advance various actuators to the home position or check that the sheet S does not remain in a conveying path to make the printer main body 1A be in a standby (ready) state where the printer main body 1A is enabled to perform the image forming operation.

In the pre-rotation control, first, after the power is turned on, the above-described presence/absence detection unit determines whether the cassette is present (S50). Here, if it is determined that the cassette 200 is absent (N in S50), an error indication is carried out (S53). Otherwise, it is determined that the cassette is present (Y in S50), the pressing drive motor 75 is rotated forward (S51), and the rack 204 moves to the home position. Then, if it is detected that the response of the photointerrupters 210*a* and 210*b* in FIG. 7 becomes A and the rack 204 moves to the home position as illustrated in FIG. 6A (Y in S52), the pressing drive motor 75 stops. As a result, the sheet feeding device 2 is in the standby state.

Figure 14:
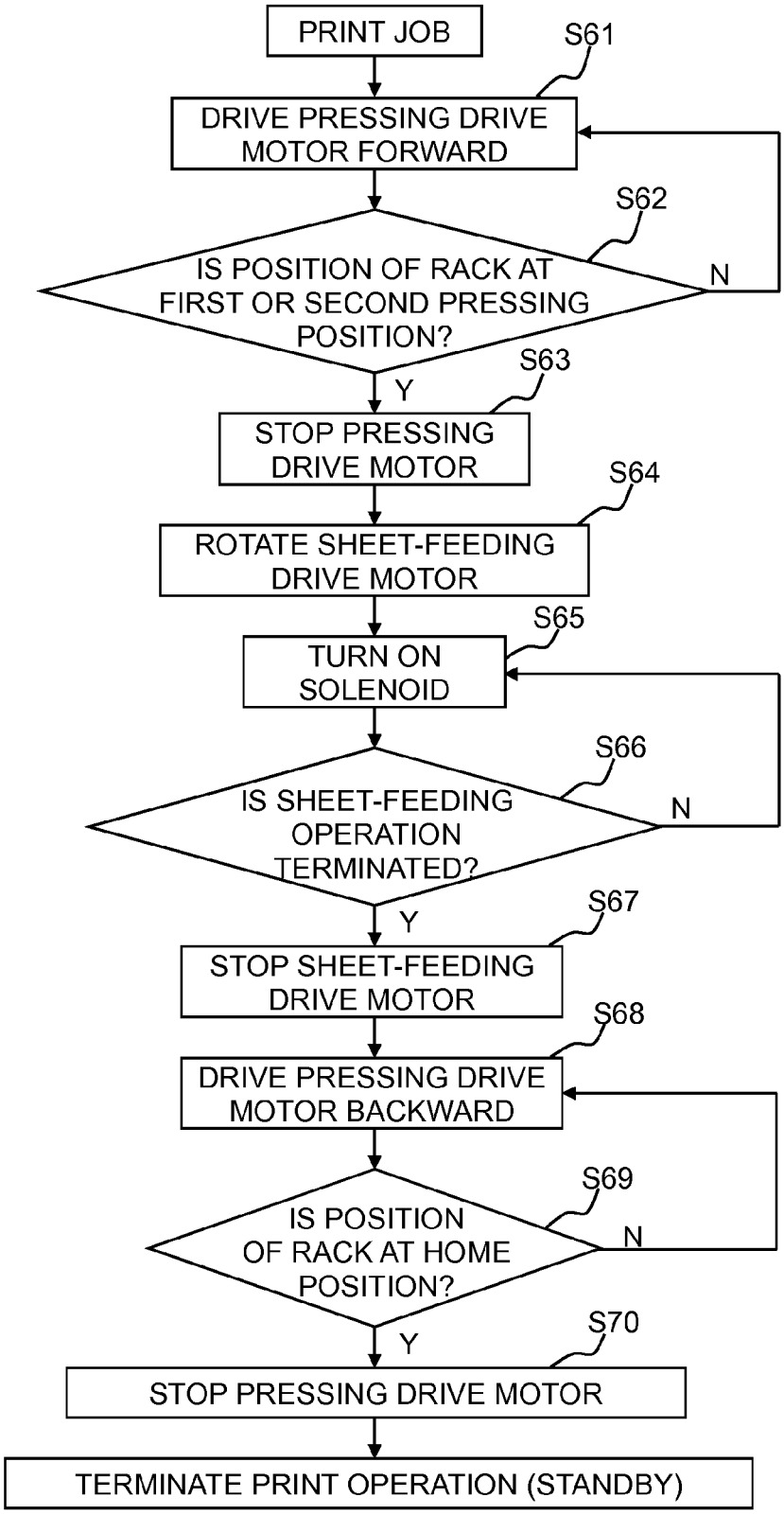
FIG. 14 is a flowchart illustrating control when the print job of the above-described full-color laser beam printer is received.

Then, the control in the case where the print job JOB is received after the standby state will be described with reference to the flowchart of FIG. 14. When the print job JOB is received, first, the sheets S stacked on the intermediate plate 201 are pressed to the feeding roller 21 with a predetermined pressing force. Therefore, the pressing drive motor 75 is driven forward (S61). In addition, the rack 204 stops at the first or second pressing position in FIG. 6C or 6D, that is, the position where the response of the photointerrupters 210*a* and 210*b* becomes C or D in FIG. 7.

Then, when the rack 204 stops at the first or second pressing position, that is, when the position of the rack 204 is set to the first or second pressing position (Y in S62), the pressing drive motor 75 stops (S63), and the sheet-feeding drive motor 76 is driven so as to rotate the feeding roller 21 (S64). In addition, in synchronization with the image formation, the solenoid 19 is turned on (S65), and the locking of the solenoid 19 with the armature 192 described above is released. As a result, the drive transmission portion 14A switches from the first state in which the driving of the sheet-feeding drive motor 76 is transmitted to the feeding roller 21 to the second state in which the driving of the sheet-feeding drive motor 76 is not transmitted to the feeding roller 21. Then, until a predetermined number of sheets S are fed, that is, until the sheet-feeding operation is terminated (N in S66), the solenoid 19 is turned on. When the sheet-feeding operation is terminated (Y in S66), the sheet-feeding drive motor 76 stops (S67).

Then, the pressing drive motor 75 is driven backward (S68). In addition, when the rack 204 is at the home position illustrated in FIG. 6A, that is, the position where the response of the photointerrupters 210*a* and 210*b* becomes A in FIG. 7 (Y in S69), the pressing drive motor 75 stops (S70). In this case, the sheet S and the feeding roller 21 are separated (at the standby state) so that the print operation is terminated.

Here, the time of rotation of the sheet-feeding drive motor 76 can be shortest considering operational sound, power consumption, reduction of lifetimes caused by partial cutting of components such as gears or rollers moving as the sheet-feeding drive motor 76 is rotated. For this reason, according to the present embodiment, when the drive control of the feeding roller 21 is performed, the sheet-feeding drive motor 76 is rotated as much as necessary to feed the sheet S.

For example, if a strong vibration or impact is applied when the full-color laser beam printer 1 is transported after the manufacture, or the full-color laser beam printer 1 is moved, the armature 192 of the solenoid 19 may be deviated from the locking portion 143*a* of the tooth-chipping control cam 143. That is, if a strong vibration or impact is applied, and when the drive transmission portion 14A is switched from the second state to the first state and the sheet is fed, the solenoid 19 which is a switching portion for holding, in the second state, the drive transmission portion 14A returning from the first state to the second state by virtue of the driving of the sheet-feeding drive motor 76, is unlocked.

Here, in a case where the armature 192 of the solenoid 19 is unlocked in this manner, the control tooth-chipped gear 142 is rotated to mesh with the drive gear 12. In addition, in the control described above, if the sheet-feeding drive motor 76 is rotated in this state, the feeding roller 21 is also rotated at the same time as the start of rotation of the sheet-feeding drive motor 76. In this case, an unintended feeding of the sheet S occurs.

Figure 15:
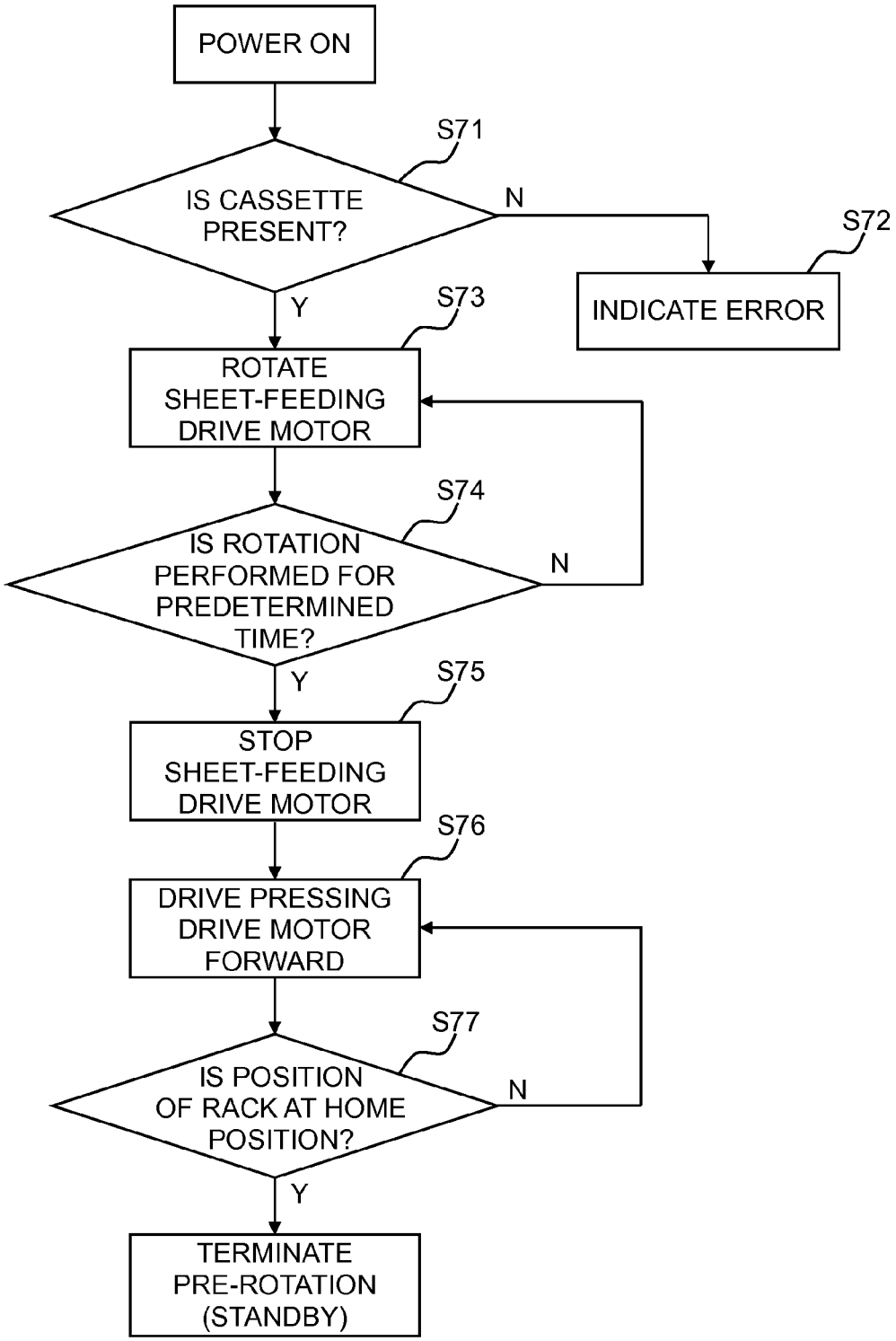

In this regard, according to the present embodiment, when the printer main body 1A is initially powered on after the manufacture, an unusual control is performed. Next, the control performed when the printer main body 1A is initially powered on will be described with reference to the flowchart illustrated in FIG. 15.

In the pre-rotation control performed when the printer main body 1A is initially powered on after the manufacture, delivery, and installation, it is first determined whether the cassette 200 is present after the power is supplied (S71). If it is determined that the cassette 200 is absent (N in S71), an error indication is displayed (S72). If it is determined that the cassette 200 is present (Y in S71), the sheet-feeding drive motor 76 is rotated (S73). According to the present embodiment, whether the printer main body 1A is initially powered on after the manufacture is determined based on information stored in the RAM 723 of the image forming controller 72 of the printer main body 1A.

Then, the sheet-feeding drive motor 76 is rotated for a predetermined time (S74). Here, the predetermined time for rotating the sheet-feeding drive motor 76 may be set to be equal to or longer than the time (which is taken for one turn) necessary to cut off a rotational force from the drive gear 12 to the drive tooth-chipped gear 141 and the control tooth-chipped gear 142. That is, the predetermined time may be the time taken for returning the drive transmission portion 14A from the first state to the second state. By rotating the sheet-feeding drive motor 76 for a predetermined time in this manner, the drive tooth-chipped gear 141 and the control tooth-chipped gear 142 reach the standby position where the tooth-chipped portion faces the drive gear 12. That is, by rotating the sheet-feeding drive motor 76 for a predetermined time taken to return the drive transmission portion from the first state to the second state, it is possible to return the drive tooth-chipped gear 141 and the control tooth-chipped gear 142 to the standby position even when the locking of the armature 192 is released.

Then, when the sheet-feeding drive motor 76 is rotated for a predetermined time in this manner (Y in S74), the sheet-feeding drive motor 76 stops (S75). Then, the pressing drive motor 75 is driven forward (S76). Then, as illustrated in FIG. 6A, if it is detected that the rack 204 is positioned at the home position (Y in S77), the pressing drive motor 305 stops. As a result, the pre-rotation of the sheet feeding device 2 is terminated to enter the standby state.

In this manner, according to the present embodiment, when the printer main body 1A is initially powered on after the manufacture, the sheet-feeding drive motor 76 is driven before the pressing drive motor 75 is rotated, so that the rotational force from the drive gear 12 to the tooth-chipped gears 141 and 142 is cut off. That is, when power is initially supplied after the manufacture, the intermediate plate 201 is lifted, and the sheet-feeding drive motor 76 is driven before the sheet abuts the feeding roller 21 so as to return the drive tooth-chipped gear 141 and the control tooth-chipped gear 142 to the standby position. That is, when power is initially supplied after the manufacture, the drive transmission portion 14A is returned from the first state to the second state by driving the sheet-feeding drive motor 76.

As a result, even when the sheet-feeding drive motor 76 is driven while the locking by the armature 192 of the solenoid 19 is released due to vibration during the transportation or movement work, the drive tooth-chipped gear 141 and the control tooth-chipped gear 142 are returned to the standby position. Therefore, the feeding roller 21 is not rotated. In addition, when the drive tooth-chipped gear 141 and the control tooth-chipped gear 142 are returned to the standby position, the feeding roller 21 is also rotated. However, according to the present embodiment, the operation of the intermediate plate 201 and the rotational operation of the feeding roller 21 are controlled independently from each other. For this reason, the feeding roller 21 and the sheet S are not allowed to abut each other. As a result, since the drive tooth-chipped gear 141 and the control tooth-chipped gear 142 are returned to the standby position, the sheet S is not fed even when the feeding roller 21 is rotated. As a result, it is possible to prevent a jam and useless consumption of the sheet S.

As described above, according to the present embodiment, when the printer main body 1A is initially powered on after the manufacture, the tooth-chipped gears 141 and 142 are rotated and stop at the standby position where the tooth-chipped portion faces the drive gear 12. That is, according to the present embodiment, as the printer main body 1A is initially powered on after the manufacture, the sheet-feeding drive motor 76 is driven for the time necessary to return the drive transmission portion 14A from the first state to the second state so as to make the drive transmission portion 14A be in the second state. If the power is turned on in this manner, by making the drive transmission portion 14A be in the second state, it is possible to prevent unnecessary sheet feeding when the power is turned on without causing additional costs such as modification or addition of devices or components.

Although description has been made by assuming that the above-described control is performed when the full-color laser beam printer 1 is initially powered on after the installation, the invention is not limited thereto. For example, the above-described control may be performed when the power is turned on in a case where the full-color laser beam printer 1 is provided in a significantly vibrating place and is not used for a long time.

However, the image forming controller 72 of the full-color laser beam printer 1 according to the present embodiment stops the sheet feeding immediately when an accident such as a jam occurs or when a user opens the access door of the printer main body 1A during the print operation (during the sheet feeding).

As a result, it is possible to prevent unrelated sheets from being fed during the jam, prevent a user from feeling difficulty in removing the jammed sheet, prevent the components of the printer main body 1A from being damaged, and prevent the sheets from being uselessly consumed. In addition, the printer main body 1A is controlled by the image forming controller 72 to immediately stop the operation even during the print operation when the door is opened for replacing consumables or removing the jam during the print operation.

Here, in a case where the paper feeding operation is initiated, and the print operation stops soon as described above, the drive tooth-chipped gear 141 and the control tooth-chipped gear 142 are not returned to the standby position. That is, the sheet-feeding drive motor 76 is not rotated after the armature 192 of the solenoid 19 is released and until it returns to the standby position. In this case, the drive tooth-chipped gear 141 and the control tooth-chipped gear 142 stop in a state where they mesh with the drive gear 12.

Figure 13:
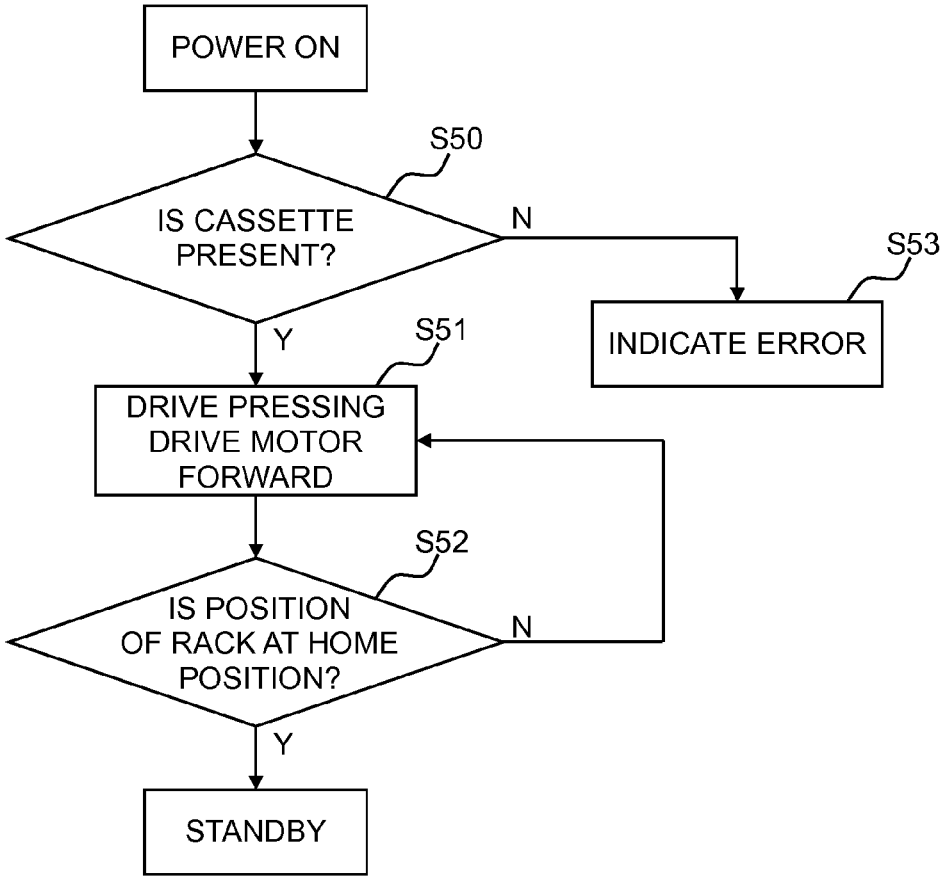

Even in this state, if a user completely closes the access door after jam recovery, the sheet feeding is resumed. However, at this moment, the printer main body 1A performs the pre-rotation operation. In this case, even when the pre-rotation control described in conjunction with FIG. 13 is performed, the drive tooth-chipped gear 141 and the control tooth-chipped gear 142 are kept in meshing engagement with the drive gear 12. For this reason, after that, if the print job JOB is initiated, the feeding roller 21 is also rotated at the same time with the rotation of the sheet-feeding drive motor 76. As a result, an unintended feeding of the sheet S and a jam occurs again.

In this regard, when the drive tooth-chipped gear 141 and the control tooth-chipped gear 142 are not returned to the standby position as described above, it is necessary to return the drive tooth-chipped gear 141 and the control tooth-chipped gear 142 to the standby position without feeding the sheet.

Next, a second embodiment according to the invention will be described, in which the drive tooth-chipped gear 141 and the control tooth-chipped gear 142 are returned to the standby position without feeding the sheet when the drive tooth-chipped gear 141 and the control tooth-chipped gear 142 are not returned to the standby position.

Figure 16:
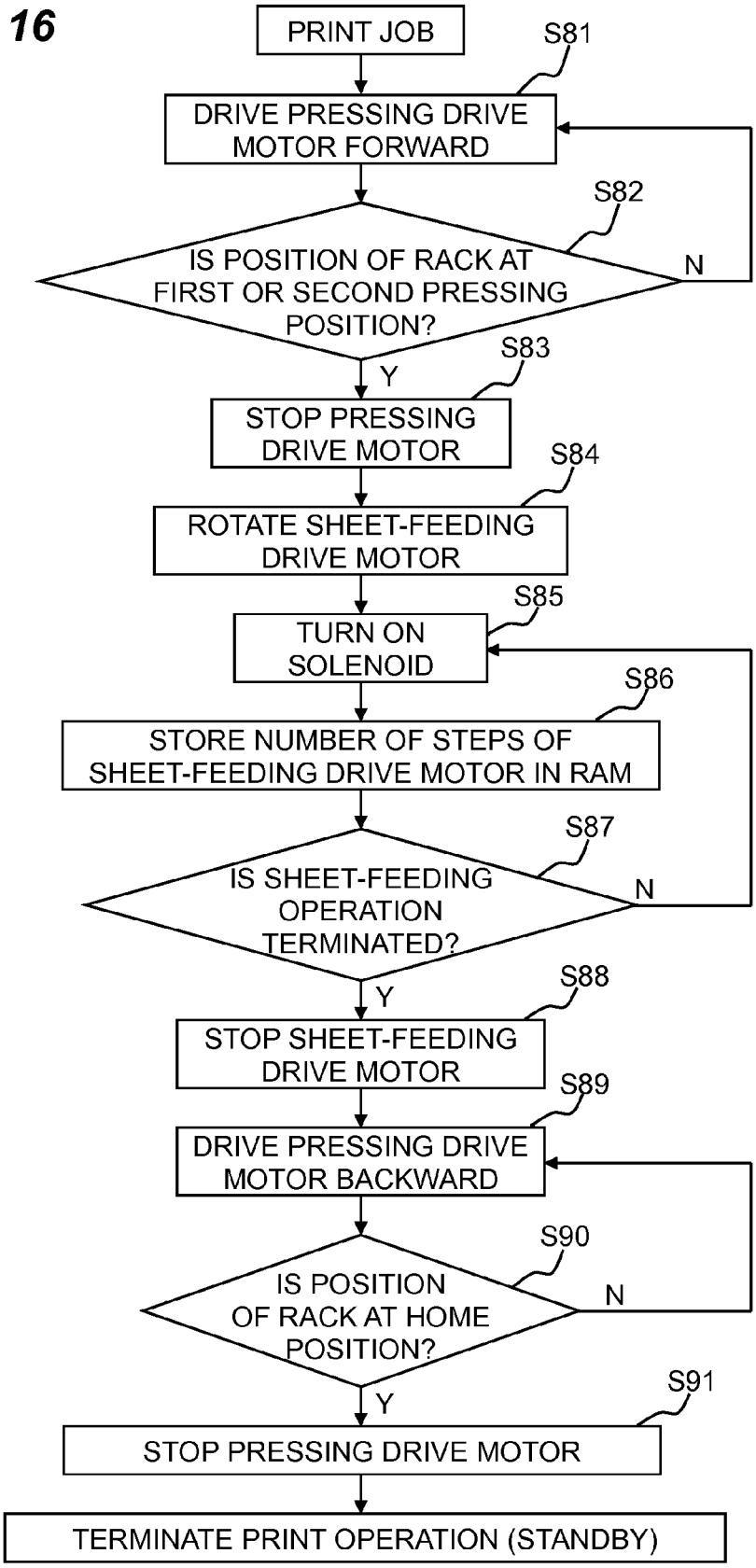
FIG. 16 is a flowchart illustrating control of the sheet feeding device provided in the image forming apparatus according to the second embodiment of the invention.

FIG. 16 is a flowchart illustrating the control of the sheet feeding device provided in the image forming apparatus according to the present embodiment. When a print job JOB is received, first, the sheets S stacked on the intermediate plate 201 are pressed to the feeding roller 21 with a predetermined pressing force, and thus, the pressing drive motor 75 is driven forward (S81). In addition, the rack 204 stops at the first or second pressing position of FIG. 6C or 6D, that is, the position where the response of the photointerrupters 210*a* and 210*b* becomes C or D in FIG. 7.

Then, as the rack 204 stops at the first or second pressing position, that is, the position of the rack 204 is set to the first or second pressing position (Y in S82), the pressing drive motor 75 stops (S83), and the sheet-feeding drive motor 76 is driven (S84). In addition, the solenoid 19 is turned on (S85) at the image formation timing, and the locking by the armature 192 of the solenoid 19 is released. Then, according to the present embodiment, the number of steps in the sheet-feeding drive motor 76 after the solenoid 19 is turned on is stored in the RAM 723 (S86).

Here, the number of steps in the sheet-feeding drive motor 76 are stored in this manner, and it is possible to compute the rotation amount of the drive tooth-chipped gear 141 and the control tooth-chipped gear 142 after the armature 192 of the solenoid 19 is released. In addition, based on the result of this computation, that is, based on the rotation amount of the drive tooth-chipped gear 141 and the control tooth-chipped gear 142, it is possible to determine whether the drive tooth-chipped gear 141 and the control tooth-chipped gear 142 are returned to the standby position.

According to the present embodiment, although the stored information is the number of steps for driving the sheet-feeding drive motor 76, the time (driving time) taken after the solenoid 19 is turned on may be stored. In a case where the time information is stored (measured) in this manner, the stored time is compared with a predetermined time necessary to return the drive tooth-chipped gear 141 and the control tooth-chipped gear 142 to the standby position. As a result, it is possible to determine whether the drive tooth-chipped gear 141 and the control tooth-chipped gear 142 are returned to the standby position. That is, according to the present embodiment, the RAM 723 forms a detection portion for detecting the positions of the drive tooth-chipped gear 141 and the control tooth-chipped gear 142 when the sheet feeding stops and is resumed.

Then, until a predetermined number of sheets are fed, that is, until the sheet feeding operation is terminated (N in S87), the solenoid 19 is turned on. When the sheet feeding operation is terminated (Y in S87), the sheet-feeding drive motor 76 stops (S88). Then, the pressing drive motor 75 is driven backward (S89). When the rack 204 is at the home position as illustrated in FIG. 6A (Y in S90), the pressing drive motor 75 stops (S91). At this moment, the sheet S and the feeding roller 21 are separated from each other (standby), and the print operation is terminated.

Figure 17:
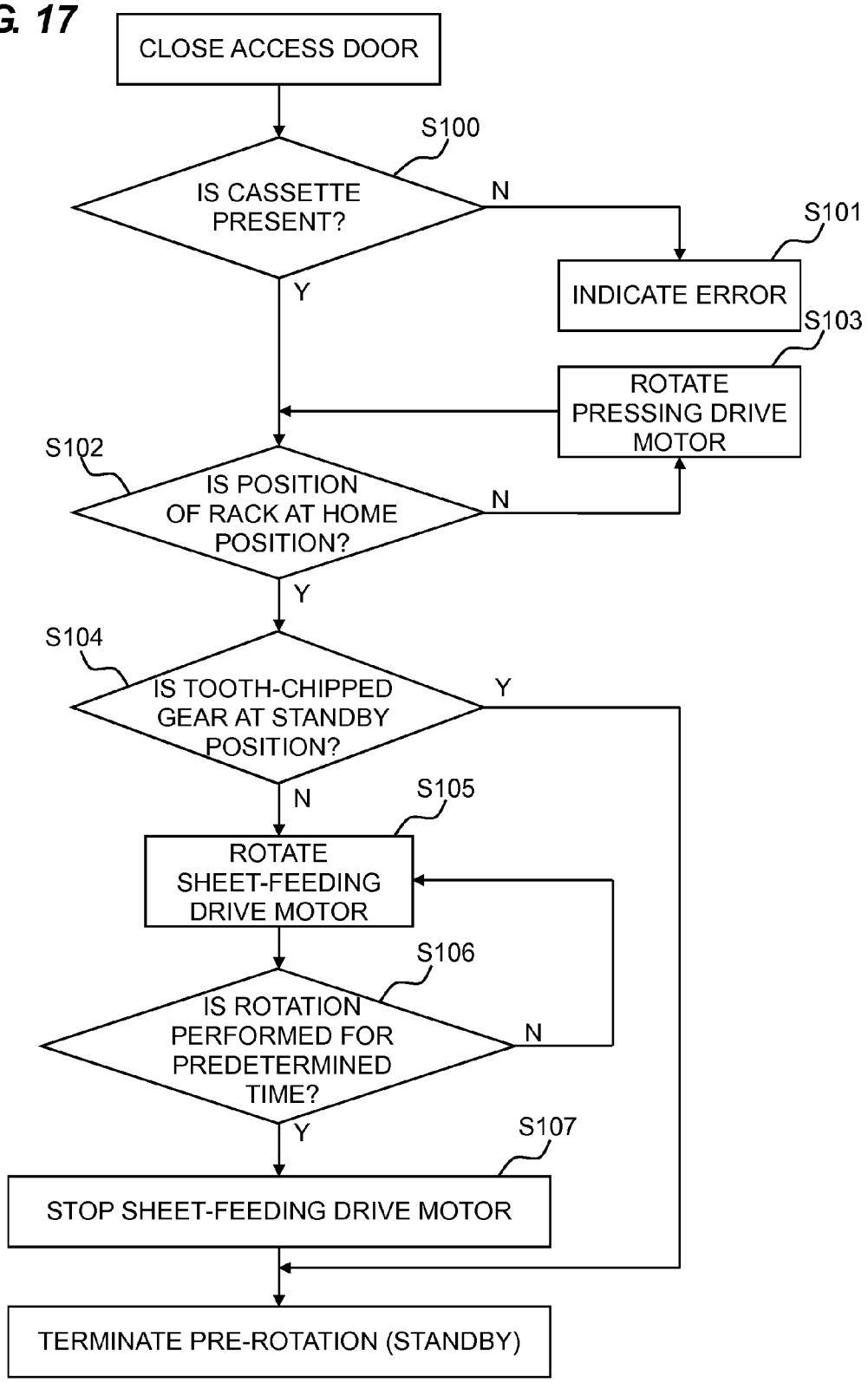
FIG. 17 is a flowchart illustrating pre-rotation control of the above-described sheet feeding device.
Figure 18:
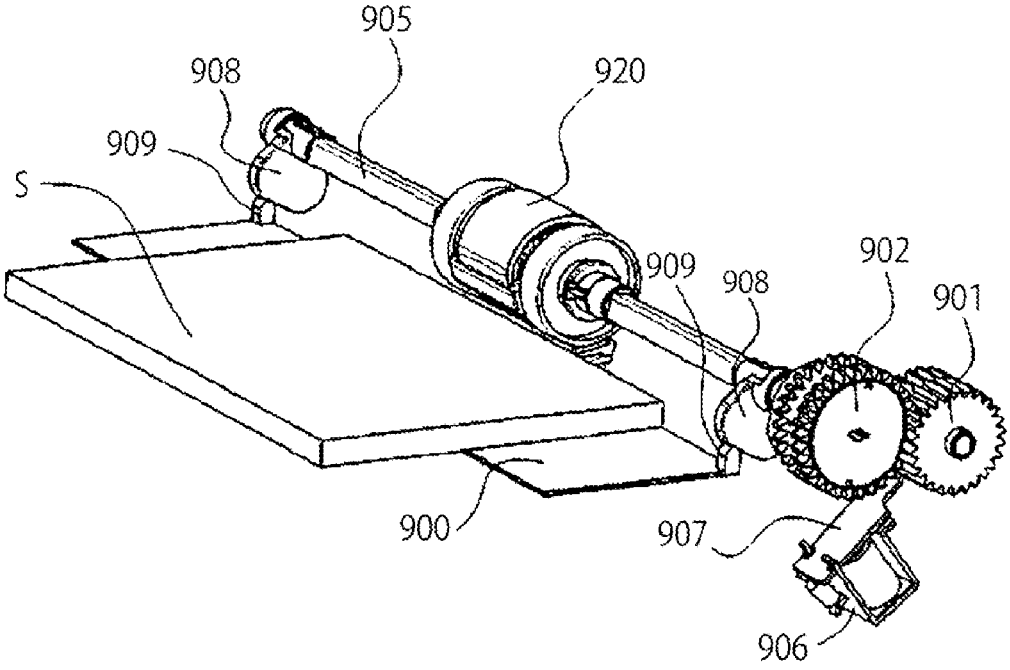
FIG. 18 PRIOR ART
FIG. 18 is a schematic diagram illustrating a sheet feeding device of the related art.
Figure 19A:
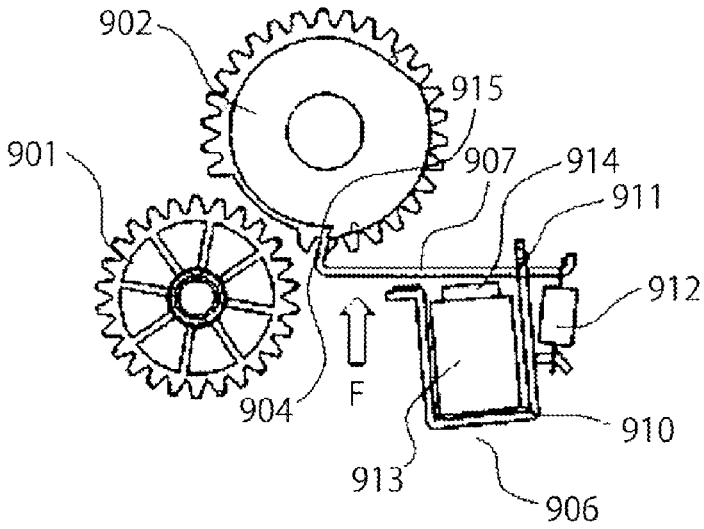
FIG. 19A PRIOR ART
FIGS. 19A and 19B are diagrams illustrating operations of the drive portion of the above-described sheet feeding device of the related art.
Figure 19B:
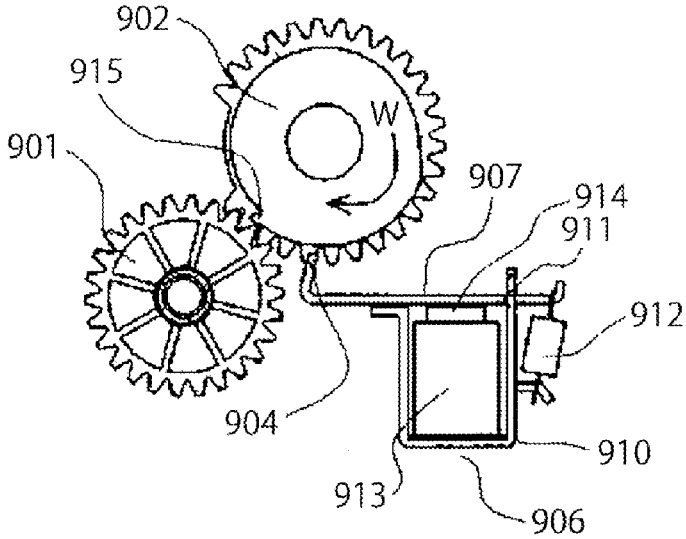
FIG. 19B PRIOR ART

However, according to the present embodiment, in a case where the drive tooth-chipped gear 141 and the control tooth-chipped gear 142 are likely to stop while they mesh with the drive gear 12 after the jam is removed or an emergency stop occurs, the control illustrated in the flowchart of FIG. 17 is performed during the pre-rotation operation. That is, for example, if a user closes the access door after the jam recovery, it is determined whether the cassette 200 is present (S100). If it is determined that the cassette 200 is absent (N in S100), the error indication is displayed (S101). Otherwise, if it is determined that the cassette 200 is present (Y in S100), it is determined whether the next sheet S is separated from the feeding roller 21, that is, whether the rack 204 is at the home position (S102). Here, if it is determined that the rack 204 is not at the home position (N in S102) and the sheet S and the feeding roller 21 abut each other, first, the pressing drive motor 75 is rotated (S103), and the rack 204 is returned to the home position.

Then, if it is determined that the rack 204 is at the home position (Y in S102), it is determined whether the drive tooth-chipped gear 141 and the control tooth-chipped gear 142 mesh with the drive gear 12 based on the information on the number of steps of the sheet-feeding drive motor 76 illustrated in FIG. 16. That is, it is determined whether a state that the drive tooth-chipped gear 141 and the control tooth-chipped gear 142 do not mesh with the drive gear 12, that is, whether the drive tooth-chipped gear 141 and the control tooth-chipped gear 142 are at the standby position where they do not mesh with the drive gear 12 (S104).

If it is determined that the drive tooth-chipped gear 141 and the control tooth-chipped gear 142 are not at the standby position (N in S104), the sheet-feeding drive motor 76 is rotated for a predetermined time (S106). The predetermined time may be set to the time necessary to cut off the rotational force from the drive gear 12 to the drive tooth-chipped gear 141 and the control tooth-chipped gear 142, that is, the time (which is taken for one turn) for preventing the drive tooth-chipped gear 141 and the control tooth-chipped gear 142 from meshing with the drive gear 12. Then, if the sheet-feeding drive motor 76 is rotated for a predetermined time (Y in S106), the sheet-feeding drive motor 76 stops (S107). As a result, the pre-rotation of the sheet feeding device 2 is terminated, and the sheet feeding device 2 is in the standby state.

In this manner, according to the present embodiment, in a case where the sheet feeding operation stops while the sheet is fed, the rack 204 is returned to the home position, and the drive tooth-chipped gear 141 and the control tooth-chipped gear 142 are returned to the standby position. Through the above-described control, even when the drive tooth-chipped gear 141 and the control tooth-chipped gear 142 are pre-rotated while they mesh with the drive gear 12, it is possible to return the tooth-chipped gears 141 and 142 to the standby position without feeding the sheet S. At this moment, although the feeding roller 21 is rotated, the feeding roller 21 and the sheet S do not abut each other. Therefore, it is possible to prevent a jam and useless consumption of the sheet S without feeding the sheet S.

As described above, according to the present embodiment, even when an accident such as a jam occurs, the drive tooth-chipped gear 141 and the control tooth-chipped gear 142 are returned to the standby position. That is, according to the present embodiment, even when an accident occurs, the sheet-feeding drive motor 76 is driven for the time necessary to return the drive transmission portion 14A from the first state to the second state so as to make the drive transmission portion 14A have the second state. As a result, it is possible to further prevent a jam or useless consumption of the sheet and make the printer main body have a standby state.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-288431, filed Dec. 24, 2010, which is hereby incorporated by reference herein in its entirety.

What is claimed is:

1. An image forming apparatus that forms an image on a sheet fed by a feeding roller from a sheet cassette mounted on an apparatus main body, the image forming apparatus comprising:

a drive portion that is provided in the apparatus main body to drive the feeding roller;

a drive transmission portion that is capable of changing between a first state in which the driving of the drive portion is transmitted to the feeding roller to feed the sheet by the feeding roller and a second state in which the driving of the drive portion is not transmitted to the feeding roller;

a switching portion that switches the drive transmission portion from the second state to the first state to make the feeding roller feed the sheet, and that returns the drive transmission portion, from the first state to the second state and stays in the second state; and a controller that drives the drive portion for a time necessary to return the drive transmission portion from the first state to the second state so as to make the drive transmission portion be in the second state when the apparatus main body is initially installed and a power of the apparatus main body is turned on.

2. The image forming apparatus according to claim 1, wherein the drive transmission portion includes a drive gear rotated by a driving force of the drive portion, a tooth-chipped gear that meshes with the drive gear to rotate the feeding roller, the switching portion releasably locking the tooth-chipped gear, and a biasing portion that applies a force to the tooth-chipped gear toward a direction that the tooth-chipped gear meshes with the drive gear, and wherein the first state is a state in which the locking by the switching portion of the tooth-chipped gear applied with a force from the biasing portion is released, and the tooth-chipped gear meshes with the drive gear, and the second state is a state in which the tooth-chipped gear applied with a force from the biasing portion is locked by the switching portion, and the tooth-chipped portion of the tooth-chipped gear faces the drive gear.

3. The image forming apparatus according to claim 1, further comprising:

a sheet stacking portion that is provided to be freely lifted and lowered in the sheet cassette to stack sheets; and a lifting and lowering drive portion that is provided in the apparatus main body to lift and lower the sheet stacking portion, wherein the controller drives the drive portion for a time necessary to return the drive transmission portion from the first state to the second state before the lifting and lowering drive portion is driven when power is turned on.

4. An image forming apparatus that forms an image on a sheet fed by a feeding roller from a sheet cassette mounted on an apparatus main body, the image forming apparatus comprising:

a drive portion that is provided in the apparatus main body to drive the feeding roller;

a drive transmission portion including a drive gear rotated by a driving force of the drive portion and a tooth-chipped gear that meshes with the drive gear to rotate the feeding roller, wherein the drive transmission portion is capable of changing between a first state in which the tooth-chipped gear meshes with the drive gear and a second state in which the tooth-chipped portion of the tooth-chipped gear faces to the drive gear;

a switching portion that switches the drive transmission portion from the second state to the first state to make the feeding roller feed the sheet, and that returns the drive transmission portion from the first state to the second state and stays in the second state;

a detection portion that detects a position of the tooth-chipped gear when a sheet feeding is resumed after the sheet feeding stops; and a controller that drives the drive portion for a time necessary to return the drive transmission portion from the first state to the second state in a case where a position of the tooth-chipped gear detected by the detection portion is not in the second state.

5. The image forming apparatus according to claim 4, wherein the detection portion detects a position of the tooth-chipped gear based on a drive time of the drive portion.

6. The image forming apparatus according to claim 4, wherein the drive portion is a stepping motor, and the detection portion detects a position of the tooth-chipped gear based on a drive time or the number of steps for driving the drive portion.

7. The image forming apparatus according to claim 4, further comprising:

a sheet stacking portion that is provided to be lifted and lowered in the sheet cassette to stack sheets; and a lifting and lowering drive portion that is provided in the apparatus main body to lift and lower the sheet stacking portion, wherein the controller drives the drive portion for a time necessary to return the drive transmission portion from the first state to the second state before the lifting and lowering drive portion is driven when power is turned on.

* * * * *